United States Patent [19]

Tokuno

[11] 4,317,719

[45] Mar. 2, 1982

[54] WET-TYPE MAGNETIC ORE SEPARATION APPARATUS

[76] Inventor: Tomotoshi Tokuno, 15-20, Shingashi 1-chome, Itabashi, Tokyo, Japan

[21] Appl. No.: 194,272

[22] Filed: Oct. 6, 1980

[51] Int. Cl.[3] ..... B03C 1/02

[52] U.S. Cl. ..... 209/223 R; 209/232; 210/222

[58] Field of Search ..... 209/39, 214, 217, 223 R, 209/225, 230, 232, 8; 210/222, 223

[56] References Cited

U.S. PATENT DOCUMENTS

| | | | |
|---|---|---|---|
| 2,074,085 | 3/1937 | Frantz | 209/232 X |
| 2,951,586 | 9/1960 | Moriya | 210/223 |
| 2,954,122 | 9/1960 | Colburn | 209/8 |
| 3,375,925 | 4/1968 | Carpenter | 209/214 |

FOREIGN PATENT DOCUMENTS

| | | | |
|---|---|---|---|
| 55-49122 | 4/1980 | Japan | 210/222 |
| 1402767 | 8/1975 | United Kingdom | 210/222 |

*Primary Examiner*—Ralph J. Hill

*Attorney, Agent, or Firm*—Wenderoth, Lind & Ponack

[57] ABSTRACT

A wet-type magnetic ore separation apparatus which comprises a main body, a magnetic field forming means provided in the central portion of said main body, a movable frame member having a magnetic material component collecting means mounted therein and movable through said magnetic field forming means, a center chamber positioned in said central portion of the main body surrounding said magnetic field forming means for collecting non-magnetic material component and side chambers positioned on the opposite sides of said center chamber for collecting magnetic material component.

1 Claim, 8 Drawing Figures

FIG.4
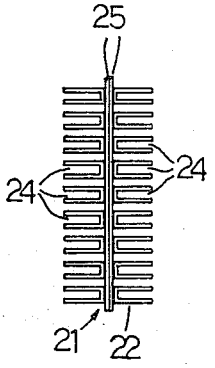
FIG.5
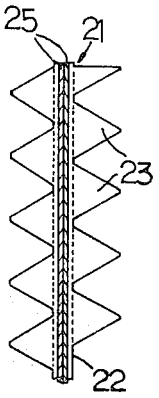
FIG.6
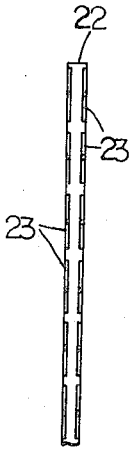
FIG.8
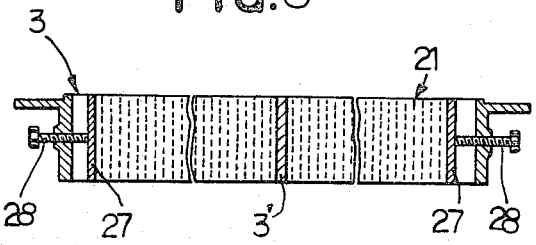
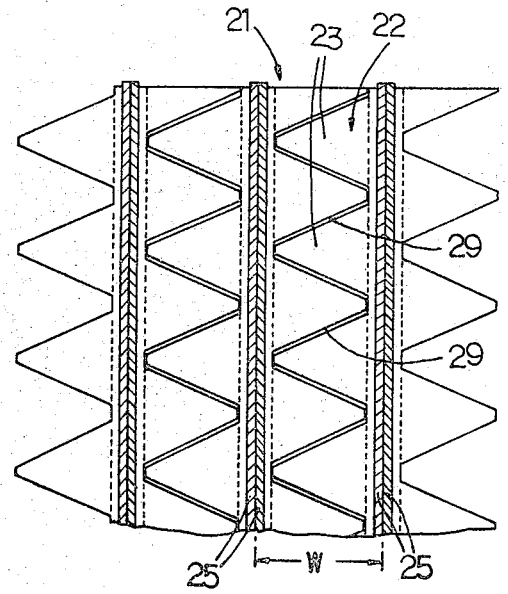
FIG.7

WET-TYPE MAGNETIC ORE SEPARATION APPARATUS

BACKGROUND OF THE INVENTION

This invention relates to a wet-type magnetic ore separation apparatus and more particularly, to a wet-type magnetic ore separation apparatus adapted to separate a magnetic material component from a non-magnetic material component in a charge of granular ore material by the utilization of magnetic force.

Conventional magnetic ore separation has been generally performed by either (1) a method in which a number of iron balls are disposed between magnetic poles to generate lines of magnetic force in a reticulate pattern and a charge of granular ore material is caused to flow down through the lines of magnetic force whereby the iron balls collect the magnetic material component from a granular ore material or (2) the method in which a belt or chain having a number of iron pieces secured thereto is passed through the magnetic field provided by an electromagnetic coil to magnetize the iron pieces and a charge of ore material is passed through the magnetic field whereby the magnetized iron pieces collect the magnetic material component from the ore material. In addition to the above-described ore separation methods, there are many other ore separation methods which are known and employed in practice. In the ore separation method (1) referred to hereinabove, the iron balls employed are preferably as small as possible so that they can be easily handled. However, the reduction of the diameter of the iron balls causes difficulties in processing and the practical use of small iron balls. When the iron balls have an extremely small diameter, ore material cannot flow down easily between the iron balls because the balls leave very restricted clearances or no clearances therebetween. Thus, the minimum practical diameter of the iron balls is about 6 mm and if the diameter of the iron balls is less than 6 mm, the magnetic material component in the granular ore material which is attracted to the iron balls cannot be easily removed from the iron balls.

In the conventional wet-type ore separation method, since a charge of ore material is caused to flow down between magnetic poles together with an amount of water to make it possible to collect the magnetic material component from the ore material, the falling speed of the water is high and the falling water tends to wash away the magnetic material component which has been previously attracted to and deposited on the magnetic poles or to prevent some of the magnetic material component which has a lower magnetism than that of the rest of the magnetic material component from being attracted to the magnetic poles. Furthermore, since the ore separation operation is performed while the ore material and water are falling down between the magnetic poles, the falling speed of the ore material and water varies along the path thereof defined by the magnetic poles. And since the falling ore material and water partially fill the clearances between the magnetic poles, but do not completely fill the clearances, some of the magnetic poles tend to fail to attract the magnetic material component in the ore material resulting in lowering of the ore separation efficiency. Furthermore, when the magnetic force provided by the magnetic poles is impractically high, only the magnetic poles positioned in the upper portion of the path of the falling ore material and water attract the magnetic material component in the ore material and the rest of the magnetic poles positioned in the portions of the path lower than the upper magnetic poles attract hardly any of the magnetic material component resulting in lowering of the ore separation efficiency.

SUMMARY OF THE INVENTION

Therefore, one principal object of the present invention is to provide a wet-type ore separation apparatus which can effectively eliminate the disadvantages inherent in the conventional ore separation apparatus and in which magnetic poles are at least partially immersed in a body of water in such a manner that all the poles can efficiently collect the magnetic material component from a charge of ore material.

Another object of the present invention is to provide a wet-type ore separation apparatus in which no obstacle is provided in the path of the iron sand or granular ore material so as to minimize frictional resistance to the ore material to be separated and a plurality of magnetic poles are provided in closely adjacent relationship so as to define needle-like clearances therebetween so that even ore material having a rather small size, such as on the order of a micron, can be effectively processed.

Another object of the present invention is to provide a wet-type ore separation apparatus in which the magnetic poles are in turn immersed in a body of water so that the falling speed of ore material and water which pass along the path provided by the magnetic poles is slowed and all the magnetic poles can attract the magnetic material component in the ore material and the weight of the ore material is reduced by the buoyancy provided by the body of water so that even magnetic component having a low magnetism such as that which is conventionally difficult to separate can be separated.

A still further object of the present invention is to provide a wet-type ore separation apparatus in which the magnetic material component attracted to the magnetic poles is washed with water before the magnetic material component is demagnetized to wash away non-magnetic material component entrapped in the magnetic material component to thereby improve the ore separation efficiency.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

BRIEF DESCRIPTION OF THE DRAWINGS

The accompanying drawings show one preferred embodiment of wet-type magnetic ore separation apparatus constructed in accordance with the principle of the present invention in which:

FIG. 4 is a fragmentary plan view of a portion of the magnetic material component collector plate assembly of the ore separation apparatus of FIGS. 1 and 2;

FIG. 5 is a front elevational view of a portion of the magnetic material component collector plate assembly of FIG. 4;

FIG. 6 is a side elevational view of the magnetic material component collector plate assembly of FIG. 4;

FIG. 7 is a front elevational view on an enlarged scale of the entire magnetic material component collector plate assembly of the ore separation apparatus of FIGS. 1 and 2; and FIG. 8 is a vertical sectional view of the movable frame member of the ore separation apparatus of FIGS. 1 and 2 with a portion thereof broken away.

PREFERRED EMBODIMENT OF THE INVENTION

Figure 1:
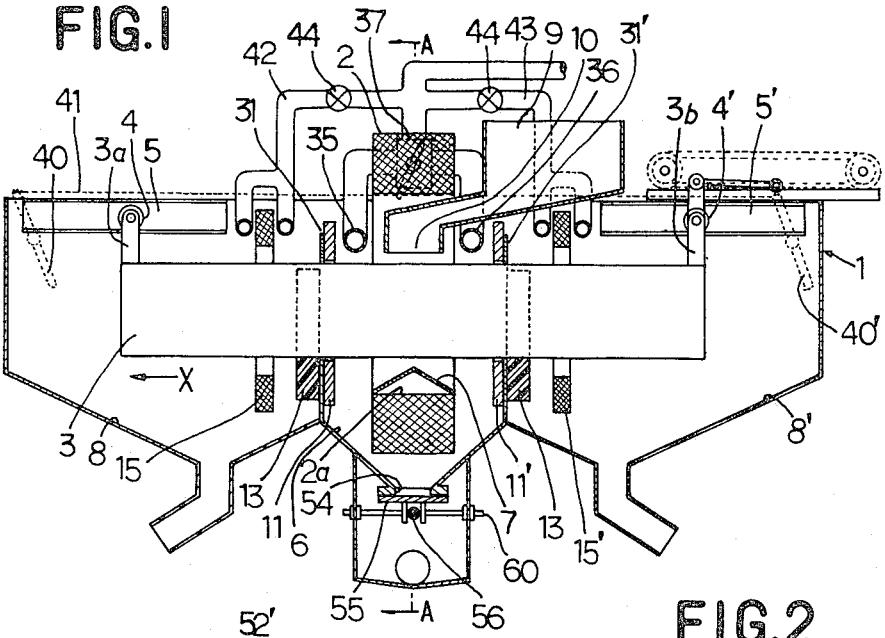
FIG. 1 is a vertical sectional view of the ore separation apparatus of the invention.

The present invention will be now described referring to the accompanying drawings which show one preferred embodiment of the invention for illustration purposes only. The wet type magnetic ore separation apparatus of the invention generally comprises a main body 1 and an electromagnetic coil 2 is mounted on the central portion of the main body and is electrically connected to a DC power source (not shown). The electromagnetic coil 2 has a center opening 2*a* therethrough and a pair of magnetic circuit forming iron pieces 11 and 11' are disposed on the opposite sides of the electromagnetic coil 2 in a spaced relationship therewith to define a magnetic field about the electromagnetic coil and have aligned openings coaxial with the center opening 2*a* in the coil 2. A movable frame member 3 which is open at the top and bottom extends through the opening 2*a* in the electromagnetic coil 2 and the aligned openings in the iron pieces 11 and 11' and is mounted for movement leftwards and rightwards as seen in FIG. 1. A pair of demagnetization coils 15 and 15' are disposed outside of the magnetic circuit forming iron pieces 11 and 11' in a slightly spaced relationship to the latter and have aligned openings coaxial with the opening 2*a* in the electromagnetic coil 2 and the aligned openings in the iron pieces 11 and 11'. The movable frame member 3 also extends through the openings in the demagnetization coils 15 and 15'. The opposite ends of the movable frame member 3 are provided with ears 3*a* and 3*b*, respectively, extending uprightly from the associated ends of the frame member and engaging wheels 4 and 4' are rotatably supported at the tops of the ears 3*a* and 3*b*, respectively. The engaging wheels 4 and 4' engage in guide rails 5 and 5', respectively, which are fixedly mounted on an upper portion of the main body 1 at the opposite ends thereof so that the movable frame member 3 can be moved horizontally with respect to the main body 1 by any conventional means (not shown).

A center funnel-shaped chamber 6 is provided in the central portion of the main body 1 substantially surrounding the magnetic circuit forming iron pieces 11 and 11' and a ramp plate 7 is provided in a lower portion of the opening 2*a* in the electromagnetic coil 2. The ramp plate 7 has a triangular cross-section to provide an upper surface which slopes in the two opposite directions from the center so as to allow non-magnetic material component to slide down the ramp plate to thereby prevent the accumulation of the non-magnetic material component within the coil opening 2*a*. Left-hand and right-hand funnel-shaped chambers 8 and 8' are provided in the main body 1 on the opposite sides of the center chamber 6.

The demagnetization coils 15 and 15' are positioned within the left-hand and right-hand chambers 8 and 8', respectively, adjacent to the opposite sides of the magnetic field. Reference numeral 9 denotes a material ore-water feed hopper which is positioned above the movable frame member 3 and has a discharge port 10 extending downwardly to communicate with the opening 2*a* in the electromagnetic coil 2 and accordingly, with the center chamber 6, and 31 and 31' denote partition plates which form the opposite side walls of the center chamber 6 and the inner walls of the left-hand and right-hand chambers 8 and 8'. The partition plates 31 and 31' also have aligned openings 11*a*, 11*a* which are coaxial with the openings in the electromagnetic coil 2, iron pieces 11 and 11', demagnetization coils 15 and 15' and partition plates 31, 31' for receiving the movable frame member 3. Secured to a lower portion of the outer surface of each of the partition plates 31 and 31' is a first packing 13 which is in water-tight sealing engagement with the bottom side edges of the movable frame member 3 and a second packing 14 is provided in contact with each side wall of the movable frame member 3 in a position above the associated first packing 13 to provide a water-tight seal with the respective side walls of the movable frame member 3.

As more clearly shown in FIG. 7, in order to provide a sufficiently water-tight seal with the movable frame member 3, the thickness of the first packings 13 is selected to be slightly greater than the width W of each plate unit in the magnetic material component collector magnetic plate assembly the description of which is given hereinafter.

Reference numeral 50 denotes a water level regulator provided on one of the side walls 12 of the center chamber 6 which are normal to the partition plates 31 and 31' and water enters the water reservoir or center chamber 6 at the inlet 16 provided in the main body 1 adjacent the one side wall 12 and is maintained at a predetermined level therein. In order to regulate the water level L within the center chamber 6, the water level regulator 50 comprises a movable plate 53 integral with a threaded bar 52 having a nut 51 thereon. The threaded bar 52 extends freely through an inwardly extending bracket 52' at the top of a vertical plate 52" positioned outside of the side wall 12 in a spaced relationship thereto to define an overflow conduit 53*a* therebetween. Thus, when the nut 51 is turned in the direction to raise the threaded bar 52 and accordingly, the movable plate 53 integral therewith, the water level L within the center chamber 6 rises and when the nut 51 is turned in the opposite direction, the water level drops.

A bottom valve 55 is disposed within an opening 54 at the bottom of the center chamber 6 and normally partially closes the bottom opening 54 to allow a small amount of water to bleed through the bottom opening 54. For this purpose, the leading end of a horizontal bar 56 which is connected to the valve 55 and pivoted to the main body at 60 is pushed upwardly by a counterweight 57 mounted at the rear end of the bar 56 for slidable movement along the bar. Mounted at the leading end of the horizontal bar 56 is a bucket 59 having small holes 58, 58 . . . and adapted to receive water overflowing from the center chamber 6 and flowing down the overflow conduit 53*a*. When the amount of water overflowing reaches a value in excess of the capacity of the small holes 58 in the bucket 59 and accumulates in the bucket, the weight of the bucket 59 overcomes the action of the counterweight 57 to thereby open the valve 55 fully. On the other hand, when the amount of water overflowing decreases to a value which the small holes 58 can handle to reduce the weight of the bucket, the bottom valve is returned to its normal position to maintain the proper water level L within the center chamber 6. The amount of water overflowing which is required to operate the bottom valve 55 is smaller than the amount of water supplied.

A magnetic material component collector magnetic plate assembly 21 is removably mounted within the movable frame member 3 and comprises a plurality of internesting magnetic plate members 22. Each of the plate members 22 includes a plurality of equally spaced triangular projections 23 extending horizontally from one side of the associated plate. The projections 23 have a U-shaped cross-section as seen in plan and define an opening 24 between each pair of the U-shape legs. As more clearly shown in FIGS. 5 and 7, the side of the plate member 22 opposite from the lateral projections 23 is suitably secured to a mounting plate 25 and the lateral projections 23 on the adjacent plate members 22 are arranged in a staggered relationship to each other so that the projections 23 on the adjacent plate members 22 in the magnetic plate assembly 21 internest except for those on the plate members 22 positioned at the opposite ends of the magnetic plate assembly. The plate members 22 are mounted within the movable frame member 3 back to back or with the mounting plates 25 of the adjacent plate members 22 in contact with each other to provide the plate assembly 21 as shown in FIGS. 7 and 8.

In the illustrated embodiment, the interior of the movable frame member 3 is divided into two chambers by means of a center vertical partition plate 3' and thus, the plate assembly 21 is divided into two plate groups as shown in FIG. 8. The magnetic plate assembly 21 is held in position by means of a pair of opposite abutment plates 27 positioned at the opposite ends of the magnetic plate assembly 21 within the movable frame member 3 and a pair of fastening bolts 28 which extend inwardly through the opposite ends of the movable frame member 3 and abut at the leading or inner ends against the abutment plates 27. The size of the internesting lateral projections 23 on the adjacent plate members 22 is so selected that the opposing inclined faces of the internesting projections 23 are spaced from each other and the opposing faces of the internesting projections 23 provide magnetic poles 29 as shown in FIG. 7. Since the poles 29 are provided by the spaced opposing faces of the internesting projections 23, when the magnetic plate assembly 21 is demagnetized in the manner as will be described hereinafter, magnetic material component which will pass through the center chamber 6 and movable frame member 3 separates easily from the poles 29. In order to enhance the ore separation function of the magnetic plate assembly 21, it is only necessary to reduce the pole clearance, the space 24 between the opposite legs of the U-shape projection 23 and the space between the adjacent projections 23. When the ore separation apparatus is operated for separation of ferromagnetic material a having high magnetization force, the pole clearance, the space 24 and the space between the projections 23 are increased to thereby increase the amount of the ferromagnetic material deposited on the magnetic plate assembly 21 and also the ore separation capacity of the magnetic plate assembly.

First and second water pipes 35 and 36 are provided on the opposite sides of the electromagnetic coil 2 and above the movable frame member 3 in a position just above the center chamber 6 within the magnetic field and in communication with each other by a conduit 37 in which a distributing valve is provided. Provided at the opposite ends of the main body 1 are a pair of lever bars 40 and 40' adapted to alternately engage the opposite ends of the movable frame member 3 and the first and second lever bars 40 and 40' are connected to the distributing valve 38 by means of a connector bar 41 so that the first and second water pipes are alternately supplied with water. Reference numerals 42 and 43 denote third and fourth water pipes provided in the main body 1 on the opposite sides of the demagnetization coils 15 and 15', respectively, above the movable frame member 3 and water amount regulation stop valves are provided in the third and fourth water pipes 42 and 43, respectively.

In operation, the center chamber 6 is filled with water to the level L, the electromagnetic coil 2 is energized and the movable frame member 3 is reciprocally moved leftwards and rightwards by a conventional drive means (not shown). Thereafter, material ore and water are thrown into the hopper 9 and the material ore and water fall down through the frame member 3 into the center chamber 6 by gravity.

By the fact that the magnetic poles 29 are magnetized when they are positioned in the magnetic field provided by the electromagnetic circuit forming iron pieces 11 and 11', the magnetic material component contained in the charge of ore falling down through the spaces 24 between the opposing legs of the projections 23 and the spaces between the adjacent projections 23 is magnetically attracted to the poles 29 whereas the remaining non-magnetic component slides down the ramp plate 7 to the bottom of the center chamber 6 where the non-magnetic component is deposited. In this case, since exposed portions of the poles 29 are positioned above the level of water L within the center chamber 6, they arrest the magnetic material component entrained in the rapidly falling water and ore material flow, and if the magnetic material component is a ferromagnetic material, such component is more positively attracted to the poles. On the other hand, since portions of the poles 29 positioned below the level of water or submerged under the water within the center chamber 6 are filled with the water, the non-magnetic material component flows downwardly therealong at a reduced rate. In this way, the magnetic material component can be effectively arrested by the poles. In addition, the weight of the magnetic material component is reduced by the buoyance provided by the body of water within the center chamber 6 and even if the magnetic material component is a low magnetic material, the low magnetic material can be efficiently attracted to the poles 29.

Figure 2:
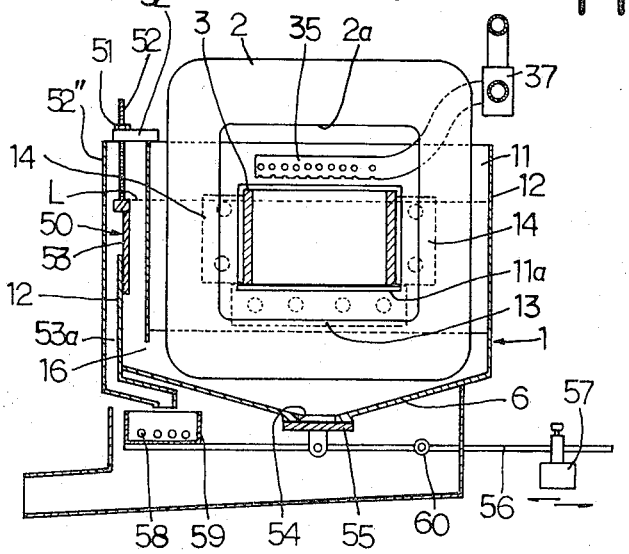
FIG. 2 is a vertical sectional view taken substantially along the line A—A of FIG. 1.
Figure 3:
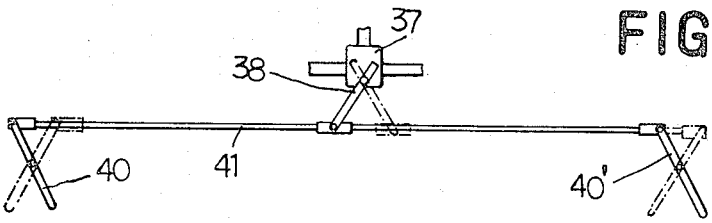
FIG. 3 is a fragmentary front elevational view showing the relationship between the distributing valve and the first and second lever bars in the ore separation apparatus of FIGS. 1 and 2.

As more clearly shown in FIG. 2, the water level L within the center chamber 6 is regulated by the movable plate 53 and the water flowing over the movable plate 53 flows down the overflow conduit **53*a* to and into the bucket 59 and normally flows out of the bucket through the small holes 58 therein. If the amount of overflowing water exceeds a value beyond the capacity of the small holes 58 in the bucket, the water accumulates within the bucket 59 to thereby increase the weight of the bucket to overcome the action of the counterweight 57, whereupon the bucket 59 pivots the bar 56 to increase the size of the opening of the bottom valve 55 to increase the flow rate of the water and non-magnetic material component through the bottom opening 54 in the center chamber 6. Then the amount of overflowing water decreases until the weight of the bucket 59 becomes smaller than that of the counterweight 57, and the counterweight pivots the bar 56 to throttle the discharge flow through the bottom valve 55 to the normal value. In this way, the level of water L within the center chamber 6 is maintained constant irrespective of the amount of the ore material and water and the non-magnetic material component of the ore material charge is discharged out of the center chamber 6** at a regulated rate together with a substantial portion of the water originally contained in the ore material supply.

The function of the first and second water pipes 35, 36 will be described hereinbelow. Although the magnetic material component is arrested by the energized poles within the magnetic field, the clearances between the poles submerged under the water within the center chamber 6 are filled with water and the movable frame member 3 moves leftwards and rightwards. In this case, since the non-magnetic material component separated from the magnetic material component is still floating in the water, if and when the non-magnetic material component floating in the water is moved into the left-hand chamber 8 or right-hand chamber 8', the non-magnetic material component remingles with the magnetic material component which has been previously separated from the non-magnetic material component and received in the chamber 8 or 8'. In order to prevent such remingling, when the movable frame member 3 moves in the direction of the arrow X as shown in FIG. 1, the first water pipe 35 allows water to flow into the chamber between the pair of mounting plates 25 to force the water in which the non-magnetic material component is floating out of the bottom of the movable frame member 3 and replace it by the fresh water from the pipe 35. That is, the fresh water from the water pipe 35 washes the magnetic material component off the magnetic poles and also washes the non-magnetic material component away from the magnetic material component. In such a case, it is only necessary to supply the fresh water in the direction outwardly of the movable frame member 3 and for this purpose, the water displacement capacity of the movable frame member 3 is calculated based on the speed of movement and capacity of the movable frame member and the distributing valve 37 allows water to flow to and into either the water pipe 35 or 36 in an amount equal to or slightly greater than the water displacement capacity of the movable frame member.

As the movable frame member 3 moves reciprocally leftwards and rightwards, the left-hand half portion and the right-hand half portion of the movable frame member 3 emerges from the magnetic field and the magnetic line of force of the poles 29 is substantially demagnetized because the magnetic line of force passes through the magnetic circuit iron pieces. However, a small amount of leak magnetism or residual magnetism still remain. Such leak or residual magnetism is completely removed by applying magnetic force in the reverse direction by the auxiliary demagnetization coils 15 and 15' whereby the magnetic material component clinging to the poles 29 is caused to fall down into the left-hand chamber 8 or the right-hand chamber 8'. Thus, the non-magnetic material component is discharged from the center chamber and the magnetic material component is discharged from the left-hand and right-hand chambers 8 and 8', respectively.

As described hereinabove, according to the present invention, since the poles to which the magnetic force is applied are immersed in the water and the clearances between the immersed poles are filled with water, the water carrying the ore material thereon flows down slowly, the magnetic material component contained in the charge of material ore can be efficiently arrested, the weight of the magnetic material component is reduced by the buoyancy provided by the water and magnetic material component of low magnetism is more effectively arrested. In addition, by the provision of the sloped poles, the ore separation can be efficiently performed without offering any resistance to the falling magnetic material component. Furthermore, since the non-magnetic material component trapped in the magnetic material component is washed off by water, the ore separation by the ore separation apparatus is enhanced.

While only one embodiment of the invention has been shown and described in detail, it will be understood that the same is for illustrative purpose only and not to be taken as a definition of the invention, reference being had for that purpose to the appended claims.

What is claimed is:

1. A wet-type magnetic ore separation apparatus comprising:

a vertically positioned electromagnetic coil having a center opening extending therethrough;

a movable frame member having a plurality of magnetic pole means mounted therein and horizontally and reciprocally movable through said opening in the electromagnetic coil;

a funnel-shaped center chamber substantially surrounding said electromagnetic coil for collecting non-magnetic component contained in a charge of ore material and having means for maintaining a liquid level therein adjacent the top of said frame member;

a pair of demagnetization coils spaced from the opposite sides of said electromagnetic coil and extending around said movable frame member for demagnetizing said magnetic pole means for enabling magnetic component to be separated from said magnetic pole means to which said magnetic component has previously been attracted;

funnel-shaped side chambers on the opposite sides of said center chamber in the direction of movement of said movable frame member and into which said frame member is movable for collecting said magnetic component from said magnetic pole means;

first and second water pipes provided on the opposite sides of said electromagnetic coil above said movable frame member for washing away non-magnetic component trapped in said magnetic component; and third and fourth water pipes provided adjacent said demagnetizing coils for washing away magnetic component remaining on said magnetic pole means;

said magnetic pole means being an assembly of vertically extending plates each having a plurality of vertically spaced flat triangular projections extending laterally of the plate member with the projections lying in a substantially vertical plane, said plates being side by side in rows extending across said frame member with unobstructed vertical spaces therebetween, the rows of plate members being spaced transversely of the direction in which the rows extend and the projections in adjacent rows projecting toward each other and the projections in adjacent rows being vertically staggered and internesting with each other and having narrow spaces therebetween.

* * * * *